United States Patent [19]

Iversen

[11] 4,305,631

[45] Dec. 15, 1981

[54] HIGH TEMPERATURE BEARING BAKEOUT PROCESS

[75] Inventor: Arthur H. Iversen, Saratoga, Calif.

[73] Assignee: Radiologic Sciences, Inc., Santa Clara, Calif.

[21] Appl. No.: 100,492

[22] Filed: Dec. 5, 1979

[51] Int. Cl.[3] ..... H01J 9/38

[52] U.S. Cl. ..... 316/18; 316/30

[58] Field of Search ..... 316/18, 19, 24, 30, 316/31

[56] References Cited

U.S. PATENT DOCUMENTS 2,223,031 11/1940 Edward ..... 316/31

2,870,315 1/1959 Lindsay ..... 316/30

4,073,558 2/1978 Benda et al. ..... 316/18

FOREIGN PATENT DOCUMENTS 106755 3/1967 Denmark ..... 316/31

724290 2/1955 United Kingdom ..... 316/19

*Primary Examiner*—John McQuade

*Attorney, Agent, or Firm*—Limbach, Limbach & Sutton

[57] ABSTRACT

In an improved bakeout process for a rotating anode type X-ray tube, the anode, during the course of baking out at temperatures between 500° to 700° C. is rotated by external magnets to prevent cold brazing of the metal lubricant-coated bearing and bearing race.

8 Claims, 1 Drawing Figure

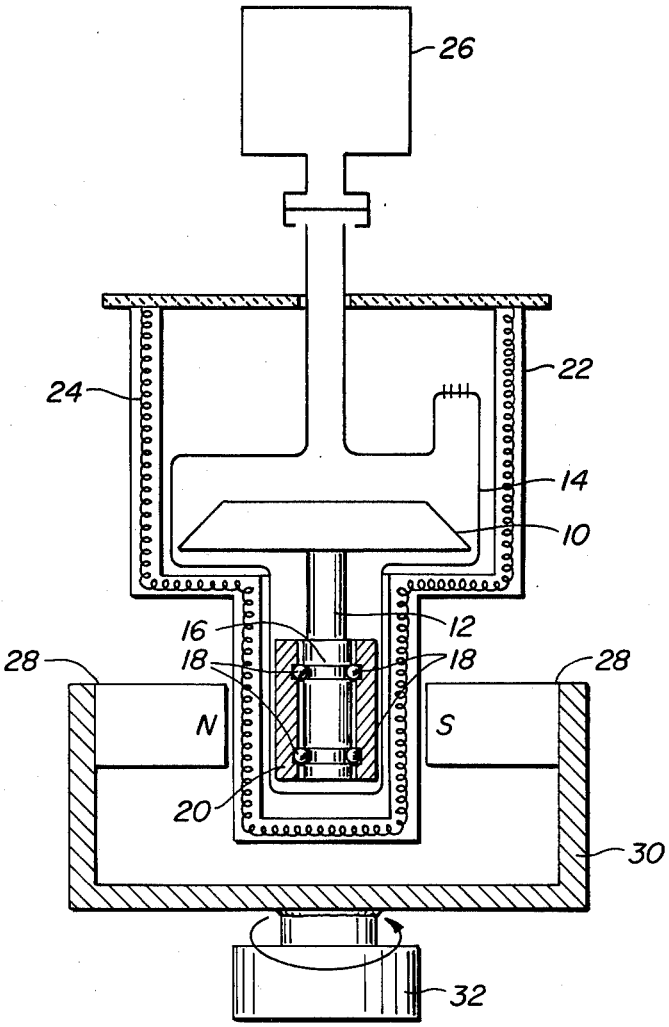
26
22
24
14
10
16
12
28
18
18
28
N
S
20
30
32

HIGH TEMPERATURE BEARING BAKEOUT PROCESS

BACKGROUND OF THE INVENTION

The rotating anode of an X-ray tube typically is mounted upon bearings as a means of rotation about an axis. In order to ensure a consistent rotatability over the life of the tube, lubrication is added in some form to the bearings. Use of a liquid is not feasible since it easily evaporates within a short time in the evacuated tube once its boiling point has been reached. Therefore, a solid lubricant is preferred. Soft metal lubricants such as silver, gold and some rare earth metals such as an ultra thin (1 micron or less) layer of titanium carbide have been proposed.

In order to remove gases incorporated into the anode and other tube components during manufacture, it is necessary to subject the tube to a high temperature bakeout under vacuum. This is especially necessary where the cathode is porous and has been impregnated with an electron emissive material; an "impregnated cathode" type tube. The standard procedure has been to bakeout the entire vacuum tube at 425° or less. Better liberation of gaseous impurities, however, occurs under higher temperatures. In general the more complete the bakeout, the longer will be the useful life of the tube.

One limitation to subjecting the tube to higher temperatures has been the glass casing of the vacuum tube itself. Now casings are composed of Pyrex with Kovar fittings. A further limitation, however, existed in the fact that at higher bakeout temperatures, even though they are below the melting point of the lubricant metal, the bearing sometimes freezes up under the weight of the anode itself when subjected to these higher temperatures. The combined action of a temperature close to the melting point of the metal lubricant and the pressure caused by the stationary anode produces a cold braze of the bearings.

SUMMARY AND OBJECTS OF THE INVENTION

The present invention circumvents the above described problem in that during bakeout at higher temperatures, such as 700° Centigrade, for example the anode, by means of external magnetic or electromagnetic sources is rotated in the bearings rather than remaining stationary. The constant rotation prevents the bearing coating from being in contact with any one surface long enough for cold brazing to take place.

It is thus an object of this invention to prevent cold brazing of the bearings to the anode shaft and to the bearing raceway during high temperature bakeout.

It is also an object of this invention to enable higher bakeout temperatures in order that volatizable impurities in the tube components are more efficiently removed.

The foregoing and other objectives, features and advantages of the invention will be more readily understood upon consideration of the following detailed description of certain preferred embodiments of the invention, taken in conjunction with the accompanying drawing.

BRIEF DESCRIPTION OF THE DRAWING

The drawing is a vertical, partially diagramatic, sectional view depicting a rotating anode X-ray tube and the apparatus for carrying out the process of the invention.

DESCRIPTION OF THE PREFERRED EMBODIMENT

The apparatus for carrying out the present invention is depicted in the drawing. A circular anode 10 mounted on a shaft 12 is rotatably mounted within a glass envelope 14. The end of the anode shaft 12 opposite from the anode 10 terminates in a conventional rotor 16 which is rotatably supported by ball bearings 18 mounted in a bearing race 20 within the tube envelope 14 in the conventional manner. Prior to the insertion of the anode and rotatable support assembly within the tube envelope 14 the bearings are coated with a soft metal lubricant such as pure silver, copper, gold or rare earth metal such as an ultra thin (1 micron or less) layer of titanium carbide with good lubricating qualities. The application of the soft metal lubricant may be on the bearings 18 or on the raceway 20 and can be done by chemical vapor deposition, sputtering or other methods which are not likely to introduce contaminants. The entire tube envelope 14 is placed within an oven 22. The oven 22 is then heated by electric coils 24 embedded in the oven wall. The oven is heated to temperatures between 550° and 700° C. which is above conventional bakeout temperatures. The tube envelope 14 is in communication with an ion pump 26 outside of the oven.

If the bearings are not moved during the bakeout process cold brazing may take place. In order to prevent this from happening it is necessary to rotate the anode 10 within the tube envelope 14 during the bakeout process. Since this would be extremely difficult to do from within the tube envelope 14, or even from within the oven 22 the applicant has designed a way to do this from the exterior of the oven 22.

This is accomplished by conforming the shape of the oven 22 to the shape of the tube envelope 14 so that the oven has a narrow neck about the rotor 16. A pair of permanent or electro magnets 28 are then rotatably supported about the narrow neck of the oven 22 and are coaxially aligned with the rotor 16. The magnets are mounted in a frame 30 which is slowly rotated by a motor 32 during the bakeout process, such as at a speed of approximately 10 revolutions per minute. The magnetic field exerted by the magnets 28 exerts a torque on the rotor 16, in a manner similar to that when the X-ray tube is operating to produce X-rays, so that the anode 10 and shaft 12 turn in the bearing race 20, with the consequence that the bearings do not remain static and cold brazing does not take place.

Although in the above embodiment the bearings were described as being coated with a metal lubricant in other embodiments the bearing race itself could be coated with the lubricant or both the bearing and the race could be coated.

The terms and expressions which have been employed here are used as terms of description and not of limitation, and there is no intention, in the use of such terms and expressions of excluding equivalents of the features shown and described, or portions thereof, it being recognized that various modifications are possible within the scope of the invention claimed.

What is claimed is:

1. An improved bakeout process for a rotating anode X-ray tube of the type having an anode rotor rotatably supported by anode bearings, wherein the process is of the type in which the evacuated X-ray tube is heated to a predetermined temperature for a predetermined time to produce outgassing, the improvement comprising the step of rotating the anode by means external to the tube envelope during the heating steps whereby cold brazing of the anode bearings is prevented.

2. An improved bakeout process as recited in claim 1 wherein the rotating step comprises the steps of revolving a magnet about the X-ray tube coaxially with the anode rotor.

3. An improved bakeout process as recited in claim 1 wherein the improvement further comprises heating the X-ray tube to a temperature of 550°–700° C. for a predetermined period of time during the heating step.

4. An improved bakeout process as recited in claim 1 further comprising the initial step, prior to the heating step, of coating the anode shaft bearings with a lubricating metal.

5. An improved bakeout process as recited in claim 4 wherein the bearing coating step comprises coating the bearings with a metal selected from the group consisting of pure silver, copper, gold, and an ultra thin (1 micron or less) layer of titanium carbide.

6. An improved bakeout process as recited in claims 1 or 4 further comprising the initial step, prior to the heating step, of coating the anode bearing race with a lubricating metal.

7. An improved bakeout process as recited in claim 6 wherein the bearing race coating step comprises coating the bearing race with a metal selected from the group consisting of pure silver, copper, gold, and an ultra thin (1 micron or less) layer of titanium carbide.

8. Apparatus for baking out an X-ray tube of the type having an evacuated envelope and a rotatable anode and anode rotor within the envelope, the apparatus comprising (a) means for evacuating the X-ray tube, (b) means for heating the evacuated tube to a temperature of between 500°–700° C., and (c) means coaxial with the axis of rotation of the rotating anode of the X-ray tube, but external to the X-ray tube and to the heating means, for generating a rotating magnetic field of sufficient strength to exert a torque on the anode rotor to cause it to rotate.

* * * * *